US006381478B2

(12) United States Patent
Enokihara et al.

(10) Patent No.: US 6,381,478 B2
(45) **Date of Patent: *Apr. 30, 2002**

(54) SUPERCONDUCTIVE HIGH-FREQUENCY CIRCUIT ELEMENT WITH SMOOTH CONTOUR

(75) Inventors: Akira Enokihara, Nara; Kentaro Setsune, Osaka, both of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/073,102

(22) Filed: May 5, 1998

(30) Foreign Application Priority Data

May 8, 1997 (JP) ..... 9-117859

(51) Int. Cl.[7] ..... H01P 7/08; H01B 12/02

(52) U.S. Cl. ..... 505/210; 333/99 S; 333/219; 505/700; 505/701; 505/866

(58) Field of Search ..... 333/219, 204, 333/99 S; 505/210, 700, 701, 866

(56) References Cited

U.S. PATENT DOCUMENTS

| | | | | |
|---|---|---|---|---|
| 4,641,116 A | * | 2/1987 | Shibata et al. | 333/219 X |
| 5,065,096 A | * | 11/1991 | Mück et al. | 333/219 X |
| 5,172,084 A | | 12/1992 | Fiedziuszko et al. | 333/204 |
| 5,750,473 A | * | 5/1998 | Shen | 505/210 |

FOREIGN PATENT DOCUMENTS

| | | | |
|---|---|---|---|
| EP | 0 660 438 | 6/1995 | |
| JP | 253302 | * 12/1985 | 333/204 |
| JP | 298202 | * 12/1987 | 333/219 |

OTHER PUBLICATIONS

Irish, R.T.; "Elliptic Resonators and it's use in Microcircuit Systems"; *Electronics Letters*; Apr. 8, 1971; vol. 7, No. 7; pp 149–150; copy in cl339/219.*

Derwent Publications Ltd., Abstract#XP–002074770 (Abstract of SU 1 679 570), Sep. 30, 1992.

Rolf Jansen, "High–Order Finite Element Polynomials in the Computer Analysis of Arbitrarily Shaped Microstrip Resonators" *Archiv für Elektronik und Übertragungstechnik*, vol. 39, No. 2, pp. 71–79, Feb. 2, 1976.

F.C. de Ronde et al., "MIC Bandfilters Using Open–Ring Resonators" 4th European Microwave Conference Proceedings, pp. 531–535, Sep. 1974.

Derwent Publications Ltd., Abstract #XP–002074771 (Abstract of SU 1 683 099), Aug. 26, 1992.

W.J. Wallace et al., "Microstrip resonators for electron–spin resonance" *Review of Scientific Instruments*, vol. 62, No. 7, pp. 1754–1766, Jul. 1, 1991.

Communication from European Patent Office and attached Search Report, Aug. 31, 1998.

T. Hayashi et al., "Coupling Structure for Superconducting Disk Filters" *Electronics Letters*, vol. 30, No. 17, pp. 1424–1425, Aug. 18, 1994.

G. Kuraishi, "Microwave Circuits", (publ. by Tokyo Denki Daigaku Shuppankyoku) pp. 203–211, and partial English translation.Mar. 30, 1983.

T. Miyoshi et al., "Analysis of Microwave Planar Circuit" *Journal of the Institute of Electronics and Communication Engineers of Japan*, vol. 55–B, No. 8, pp. 441–448, and English abstract, 1972.

* cited by examiner

*Primary Examiner*—Benny T. Lee
(74) *Attorney, Agent, or Firm*—Merchant & Gould PC

(57) ABSTRACT

A high-frequency circuit element that realizes a high degree of input-output coupling without causing an increase in loss and irregularity in impedance. A resonator made of a conductor film is formed on a substrate made of a dielectric monocrystal or the like. An input-output line made of a conductor film having a uniform line width is formed on the same surface of the substrate as the surface on which the resonator is formed. A part of the side edge of the input-output line is located along a coupling part on the peripheral part of the resonator and spaced from the resonator by a gap part.

8 Claims, 14 Drawing Sheets

SUPERCONDUCTIVE HIGH-FREQUENCY CIRCUIT ELEMENT WITH SMOOTH CONTOUR

FIELD OF THE INVENTION

The present invention relates to a high-frequency circuit element, such as a resonator, a filter or the like, used for a high-frequency signal processor in communication systems, etc.

BACKGROUND OF THE INVENTION

A high-frequency circuit element, such as a resonator, a filter or the like, is an essential component in high-frequency communication systems. The main examples of high-frequency circuit elements such as resonators, filters or the like presently used are those using a dielectric resonator, those using a transmission line structure (a microstrip structure or a strip line structure), and those using a surface acoustic wave element. Among those examples, those using a transmission line structure are small and can be applied to frequencies as high as microwaves or milliwaves. Furthermore, they have a two-dimensional structure formed on a substrate and easily can be combined with other circuits or elements, and therefore they are widely used. Conventionally, a half-wavelength resonator with a transmission line is most widely used as this type of resonator. Also, by coupling a plurality of these half-wavelength resonators, a high-frequency circuit element such as a filter or the like is formed (Minute Explanation Examples/Exercises, Microwaves Circuit, Tokyo Electrical Engineering College Publishing Office).

Other conventional examples of a transmission line structure include those using a planar circuit structure. The representative examples are those constructing various high-frequency circuits by using a disc type resonator (Papers of Institute of Electronics and Communication Engineers of Japan, 72/8 Vol.55-B No.8 "Analysis of Microwave Planar Circuit" Tanroku MIYOSHI, Takaaki OOKOSHI).

However, in a resonator having a transmission line structure such as a half-wavelength resonator or the like, high-frequency current is concentrated in a part of the conductor. Therefore, loss due to conductor resistance is relatively large, resulting in degradation in the Q value in the resonator and also an increase in loss when a filter is formed. Also, when using a half-wavelength resonator having a commonly used microstrip structure, the effect of loss due to radiation from a circuit to space is a problem.

In the case of using a circular resonator or the like as a resonator in a planar circuit structure, it is difficult to obtain a high degree of coupling that satisfies a filter design parameter in a coupling part between an inputoutput line and the resonator. The following prior art technique has been proposed as a method for obtaining a high degree of input-output coupling (FIGS. 12 and 13). That is to say, as shown in FIG. 12, a notch 30*a* is formed in a part of a resonator 30 and the point of an input-output line 31 is inserted into the notch 30*a*. This enables the degree of input-output coupling to be increased by increasing coupling capacity (T. Hayashi and others, Electronics Letters, Vol. 30, No. 17 pp. 1424). As shown in FIG. 13, the line width of the point 31*a* of an input-output line 31 is broadened, and the point 31*a* having the broadened line width is located facing the peripheral part of the resonator 30. This enables the degree of input-output coupling to be increased by increasing the coupling capacitance.

However, even when using these prior art methods, there is a limit to the increase in the degree of input-output coupling. In the former method (FIG. 12), since the notch 30*a* is formed in a part of the resonator 30, the current is concentrated at this part, thus causing an increase in loss. On the other hand, in the latter method (FIG. 13), the irregularity in impedance is caused by broadening the line width at the point 31*a* of the input-output line 31. Conversely, when making the line width of the point 31*a* too broad, the degree of input-output coupling decreases.

SUMMARY OF THE INVENTION

The present invention aims to solve the problems mentioned above in the prior art. The object of the present invention is to provide a high-frequency circuit element that can realize a high degree of input-output coupling without causing an increase in loss and irregularity in impedance.

In order to attain the object mentioned above, an aspect of a high-frequency circuit element according to the present invention comprises at least one resonator having a planar circuit structure and at least one input-output line, and is characterized in that the input-output line has a side edge and a part of the side edge of the input-output line is located along a coupling part on the peripheral part of the resonator and spaced from the resonator by a gap part. According to this aspect of the high-frequency circuit element, distributed coupling can be made by locating a part of the side edge of the input-output line along the coupling part on the peripheral part of the resonator, and spaced therefrom through the gap part. As a result, a high degree of input-output coupling can be realized without changing the peripheral shape of the resonator and the line width of the input-output line at the coupling part as in a conventional high-frequency circuit element, that is, without causing an increase in loss and irregularity in impedance.

In the aspect of the high-frequency circuit element of the present invention mentioned above, it is preferable that the input-output line has a substantially uniform width.

In the aspect of the high-frequency circuit element of the present invention mentioned above, a resonator having any shape, such as a round resonator, an elliptical resonator, a polygonal resonator or the like, can be used as the resonator in a planar circuit structure.

In the aspect of the high-frequency circuit element of the present invention mentioned above, the length of the coupling part defines the angle with respect to the center of the resonator. It is preferable that the angle is set in the range of 5–30°.

In the aspect of the high-frequency circuit element of the present invention mentioned above, it is preferable that the distance between the coupling part on the periphery of the resonator and the input-output line (the gap part) is set in the range of 10–500 $\mu$m.

It is preferable that the high-frequency circuit element of the present invention mentioned above has a microstrip structure or a strip line structure. The microstrip structure is simple in structure and has good coherency with other circuits. The strip line structure enables a high-frequency circuit element having small loss to be realized, since the radiation loss is very small.

In the aspect of the high-frequency circuit element of the present invention mentioned above, it is preferable that an elliptical resonator is used as a resonator in a planar circuit structure and two input-output lines are coupled to the resonator, wherein the coupling parts are in the vicinity of the intersections of the periphery of the resonator with the major axis of the ellipse and the minor axis of the ellipse respectively and are provided at the positions about 90° apart from each other with respect to the center of the resonator. This preferable example can be operated as a band pass filter. It is conceivable that it can be operated as a two-stage resonator coupled filter by utilizing the coupling between two resonance modes of the elliptical resonator.

In the aspect of the high-frequency circuit element of the present invention mentioned above, it is preferable that a superconductor is used as a material of the resonator. According to this preferable example, a high-frequency circuit element having small loss and excellent power endurance characteristics can be realized.

PREFERRED EMBODIMENTS OF THE INVENTION

The present invention is described further using concrete embodiments as follows.

<First Embodiment>

Figure 1:
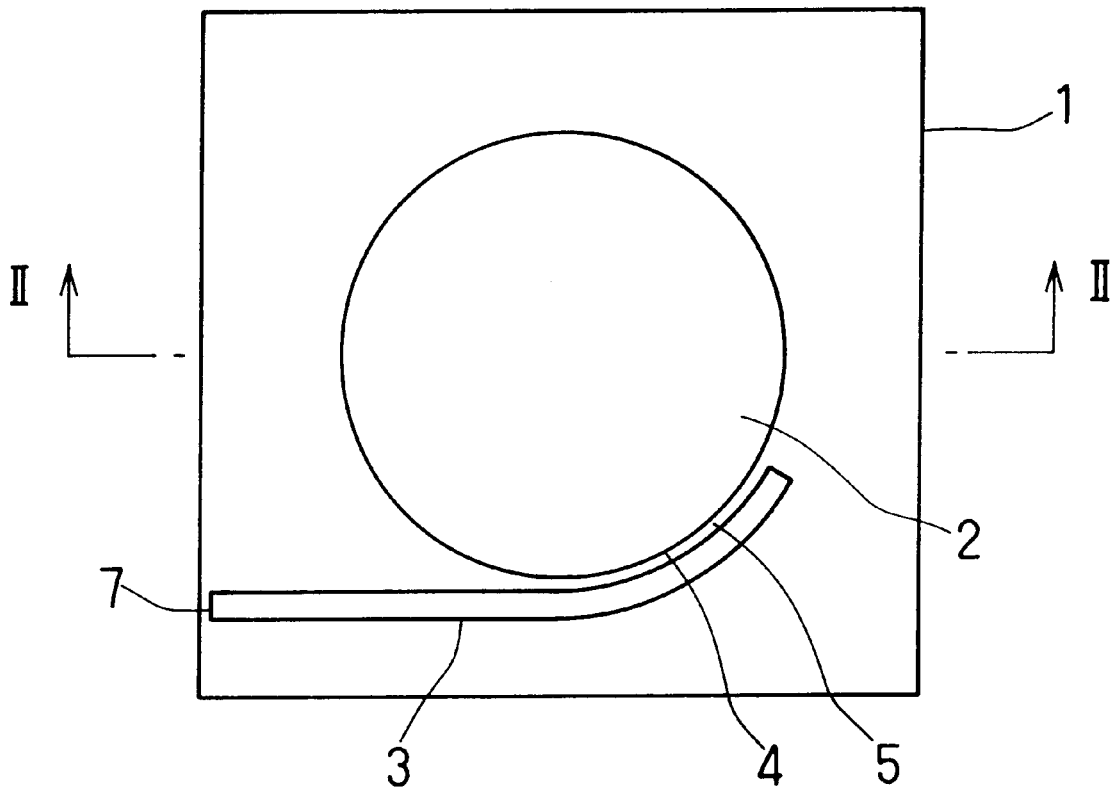
FIG. 1 is a plan view showing a first embodiment of a high-frequency circuit element according to the present invention.
Figure 2:
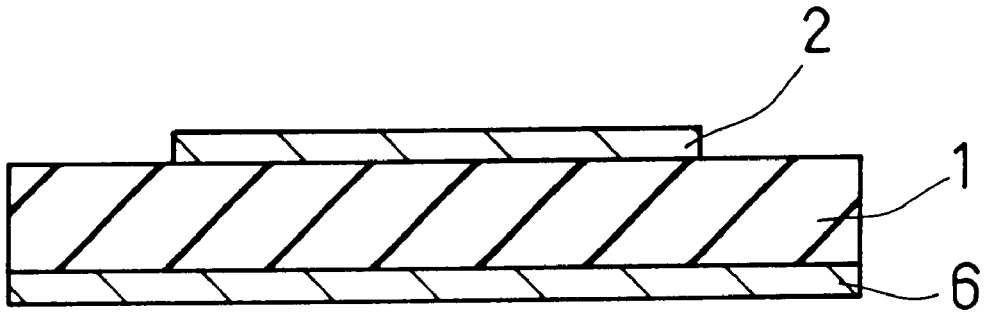
FIG. 2 is a cross-sectional view along line II—II in FIG. 1.

FIG. 1 is a plan view showing a first embodiment of a high-frequency circuit element according to the present invention. FIG. 2 is a cross-sectional view along line II—II in FIG. 1. As shown in FIGS. 1 and 2, a circular resonator 2 made of a conductor film is formed at the center on a substrate 1 made of a dielectric monocrystal or the like by using, for example, a vacuum evaporation method and etching. As best seen in FIG. 1, an input-output line 3 made of a conductor film is formed on the same surface of the substrate 1 as the surface on which the resonator 2 is formed by using, for example, a vacuum evaporation method and etching. In this case, the input-output line 3 has a side edge and its line width is uniform. In addition, a part of the side edge of the input-output line 3 is located along a coupling part 4 on the peripheral part of the resonator 2 and spaced from the resonator by a gap part 5. A ground plane 6 made of a conductor film is formed on the entire back surface of the substrate 1 by using, for example, a vacuum evaporation method as shown in FIG 2. This enables a high-frequency circuit element having a microstrip structure to be realized.

As a material of the conductor film, a high-temperature oxide superconductor represented by a yttrium (Y) family superconductor such as $YBa_2Cu_3O_x$ or the like, a bismuth (Bi) family superconductor such as $Bi_2Sr_2Ca_2Cu_3O_x$ or the like, a thallium (Tl) family superconductor such as $Tl_2Ba_2CaCu_2O_x$ or the like; a metallic superconductor such as Nb or the like; or a metal such as gold, copper or the like, etc. can be used.

Figure 3:
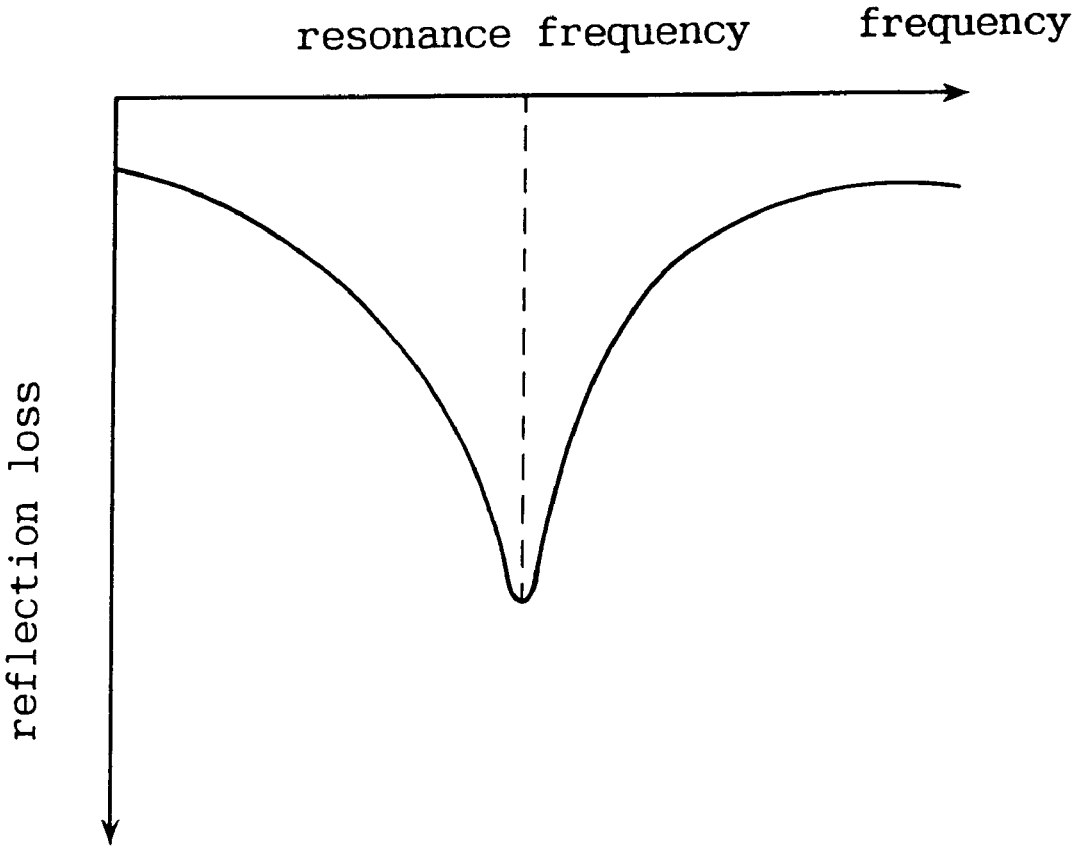
FIG. 3 is a graph showing reflection characteristics of a high-frequency circuit element of the first embodiment of the present invention.

When inputting a high-frequency signal from a terminal part 7 (see FIG. 1) of the input-output line 3 in a high-frequency circuit element having the structure mentioned above, the high-frequency signal couples with the resonator 2 at the coupling part 4, thus inducing resonance operation FIG. 3 shows reflection characteristics with respect to the frequency. It can been seen from FIG. 3 that the resonant characteristic has the peak at the resonance frequency. In this case, the characteristic inherent in a resonance circuit that great absorption occurs at the resonance frequency of the resonator 2 can be obtained as shown in FIG. 3.

Figure 12:
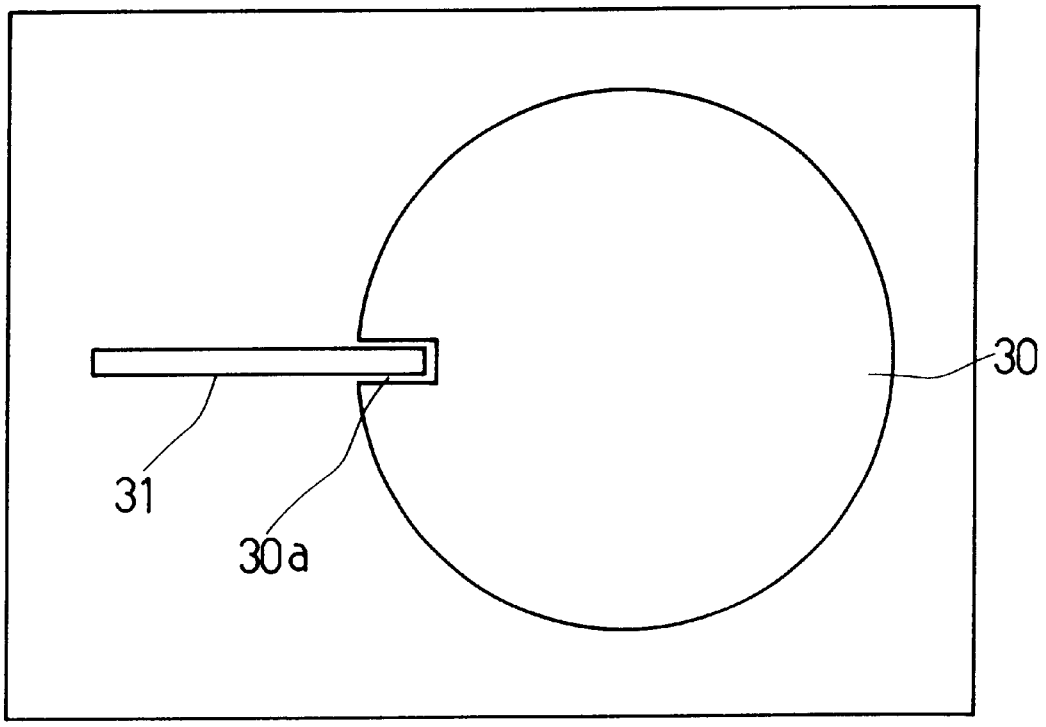
FIG. 12(PRIOR ART)
FIG. 12 is a plan view showing an example of a high-frequency circuit element in the prior art.
Figure 13:
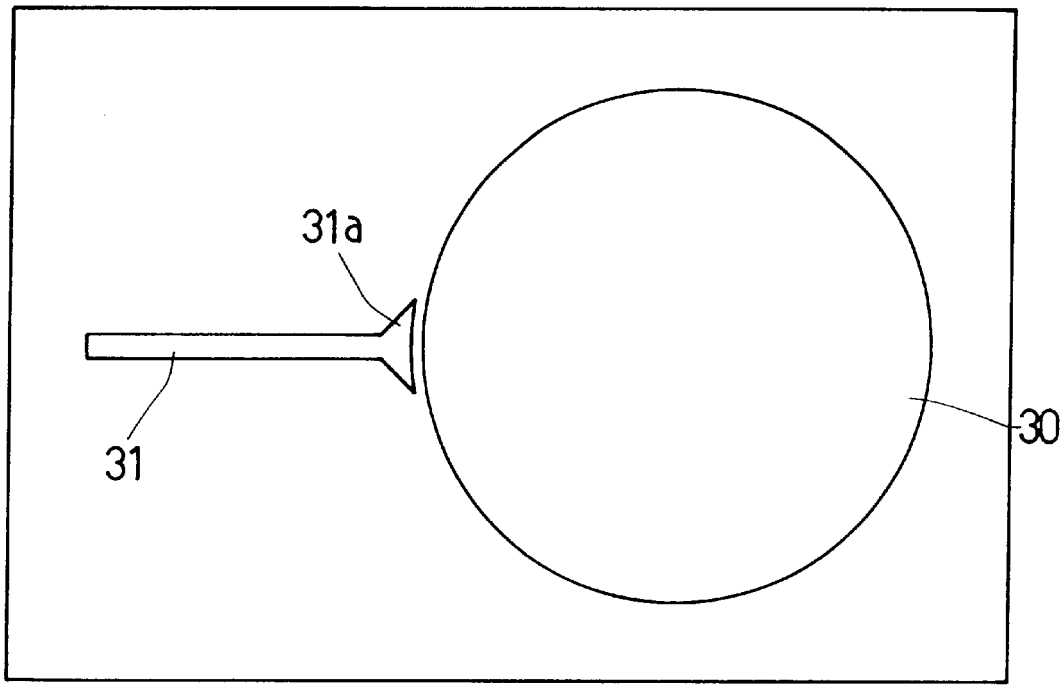
FIG. 13(PRIOR ART)
FIG. 13 is a plan view showing another example of a high-frequency circuit element in the prior art.

A conventional high-frequency circuit element shown in FIGS. 12 and 13 utilizes the effect of capacitive coupling alone depending on the capacity at a coupling part. However, in the high-frequency circuit element of the present embodiment, the effect of distributed coupling by a magnetic field is added. As a result, a higher degree of coupling can be obtained compared to that in the conventional high-frequency circuit element. That is to say, as in the present embodiment, the distributed coupling can be made by locating a part of the side edge of the input-output line 3 along the coupling part 4 on the peripheral part of the resonator 2, and spaced therefrom through the gap part 5. As a result, a high degree of input-output coupling can be realized without changing the peripheral shape of the resonator 2 at the coupling part 4 and the line width of the input-output line 3, in other words, without causing an increase in loss and irregularity in impedance as in the conventional high-frequency circuit element shown in FIGS. 12 and 13.

The present invention is to be described further in detail referring to examples of the present embodiment as follows.

Figure 4:
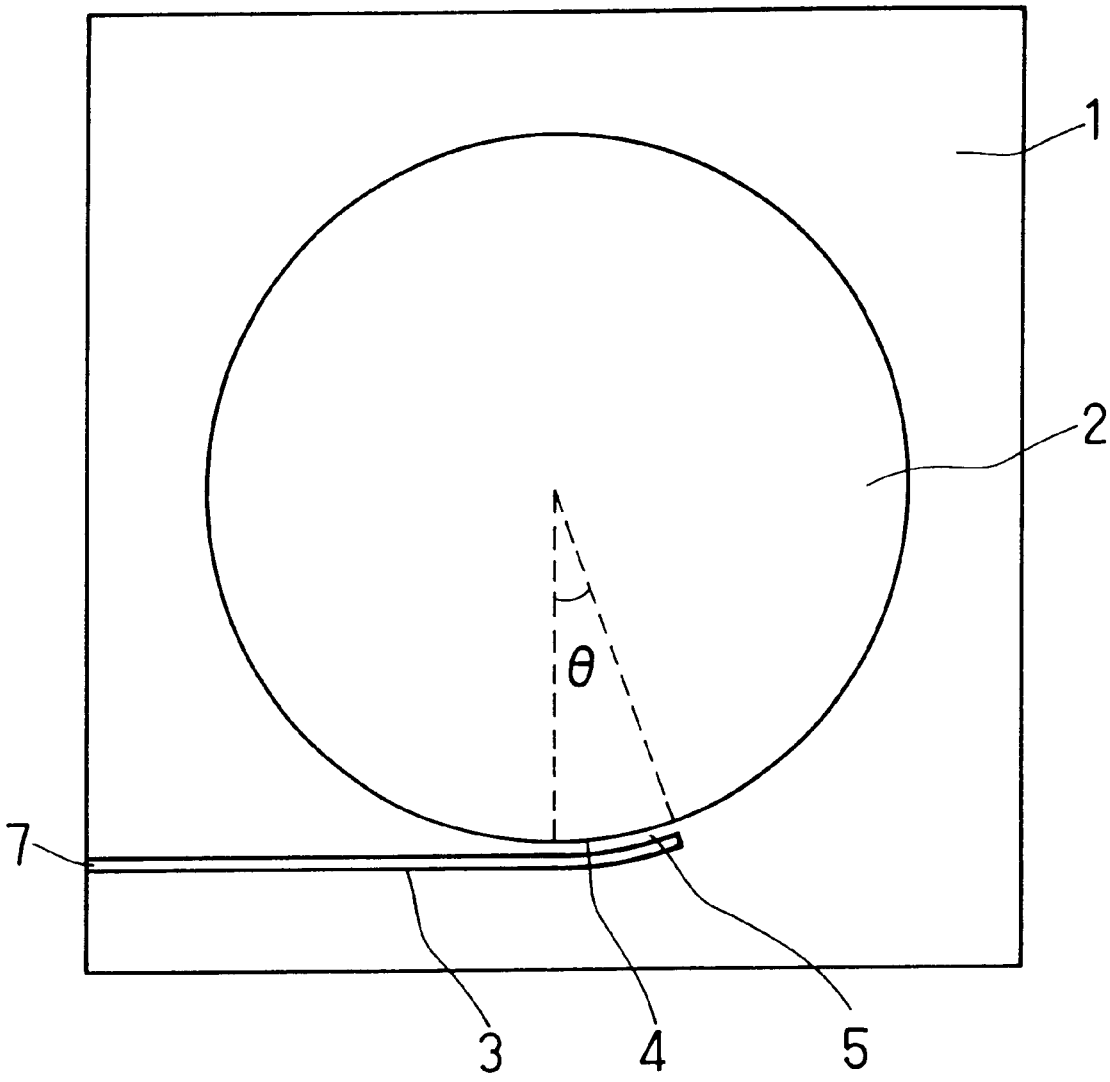
FIG. 4 is a plan view showing another aspect of the first embodiment of a high-frequency circuit element according to the present invention.

FIG. 4 is a plan view showing another aspect of the first embodiment of the high-frequency circuit element according to the present invention. As shown in FIG. 4, a circular resonator 2 made of a thallium-based high-temperature oxide superconductor having a thickness of 0.7 $\mu$m is formed at the center on a substrate 1 made of a lanthanum alumina ($LaAlO_3$) monocrystal having a thickness of 0.5 mm. In this case, the radius of the resonator 2 is 9.53 mm. An input-output line 3 also made of a thallium-based high-temperature oxide superconductor having a thickness of 0.7

μm and a line width of 0.175 mm is formed on the same surface of the substrate 1 as the surface on which the resonator 2 is formed. Apart of the side edge of the input-output line 3 is located along the coupling part 4 on the peripheral part of the resonator 2, spaced from the resonator by the gap part 5. In this case, the distance between the coupling part on the periphery of the resonator and the input-output line (the gap part 5) is 20 μm. The length of the coupling part 4 is indicated by the angle θ seen with respect to the center of the resonator 2. A ground plane (not shown in the figure) also made of a thallium-based high-temperature oxide superconductor having a thickness of 0.7 μm is formed on the entire back surface of the substrate 1. When inputting a high-frequency signal from a terminal part 7 of the input-output line 3 in a high-frequency circuit element having the structure mentioned above, the high-frequency signal couples with the resonator 2 at the coupling part 4, thus inducing resonance operation.

Figure 5:
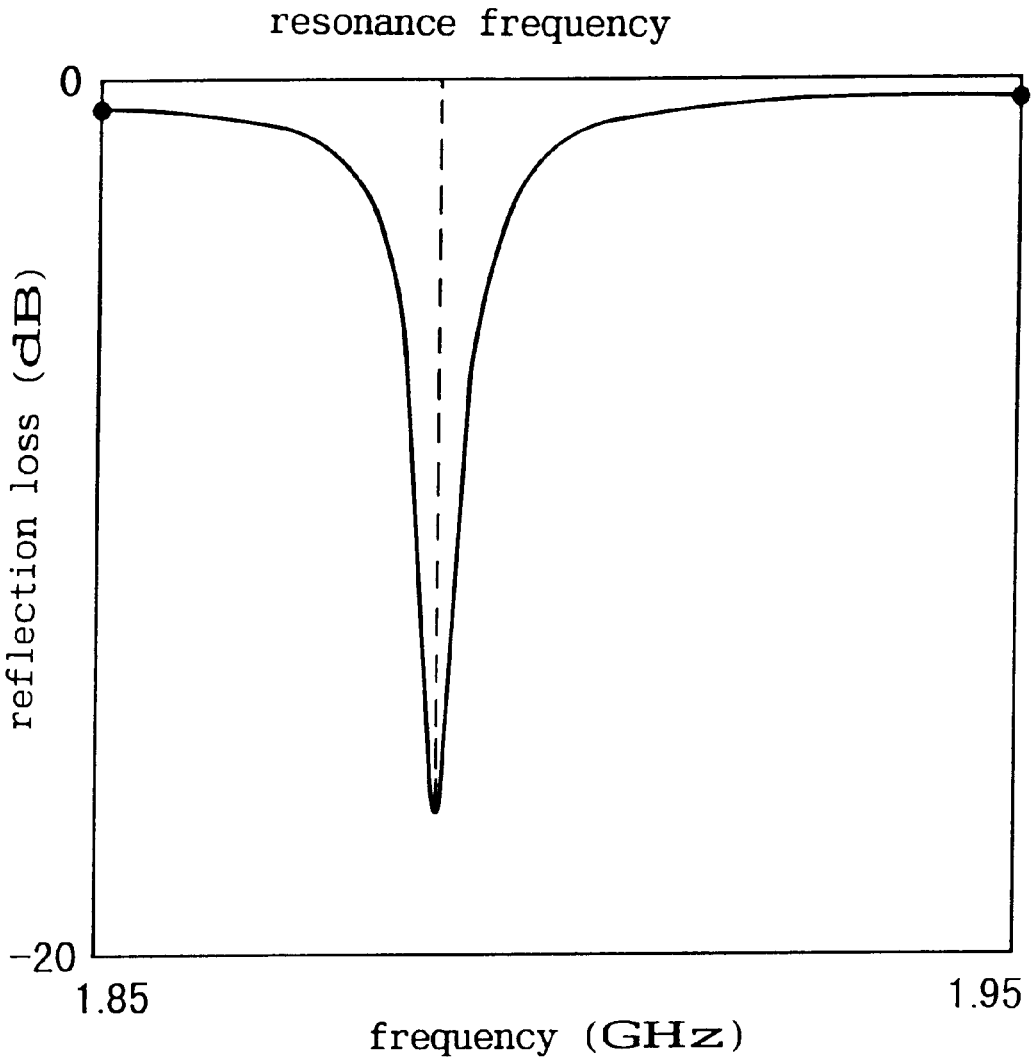
FIG. 5 is a graph showing reflection characteristics of another aspect of a high-frequency circuit element of the first embodiment of the present invention.

In FIG. 5, the reflection characteristic with respect to the frequency in the case of θ=10° is shown. As shown in FIG. 5, it can be seen that the characteristic inherent in a resonance circuit that great absorption occurs at the resonance frequency of the resonator 2 can be obtained.

Figure 6:
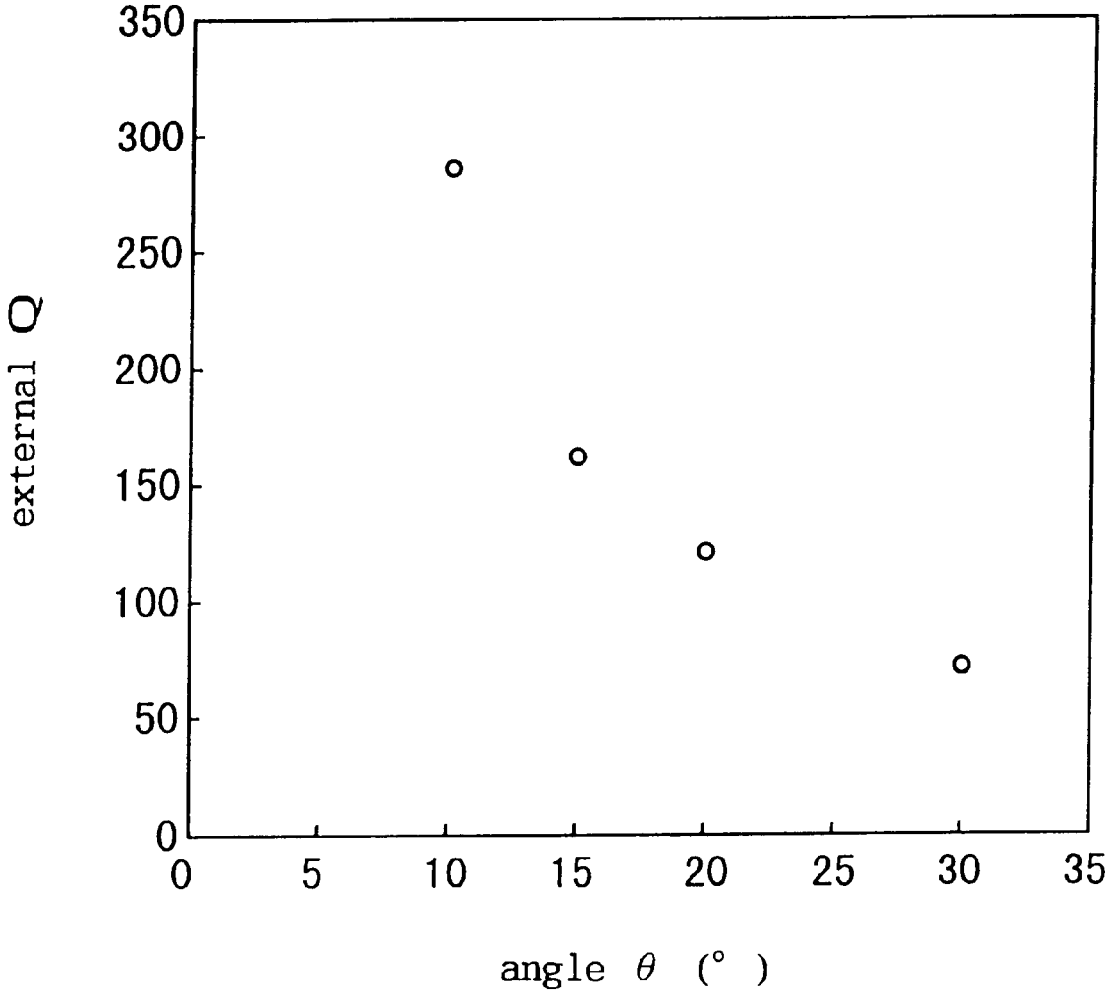
FIG. 6 is a graph showing the relationship between the length of the coupling part indicated by the angle θ and the degree of input-output coupling indicated by the external Q in another aspect of a high-frequency circuit element of the first embodiment of the present invention.
Figure 14:
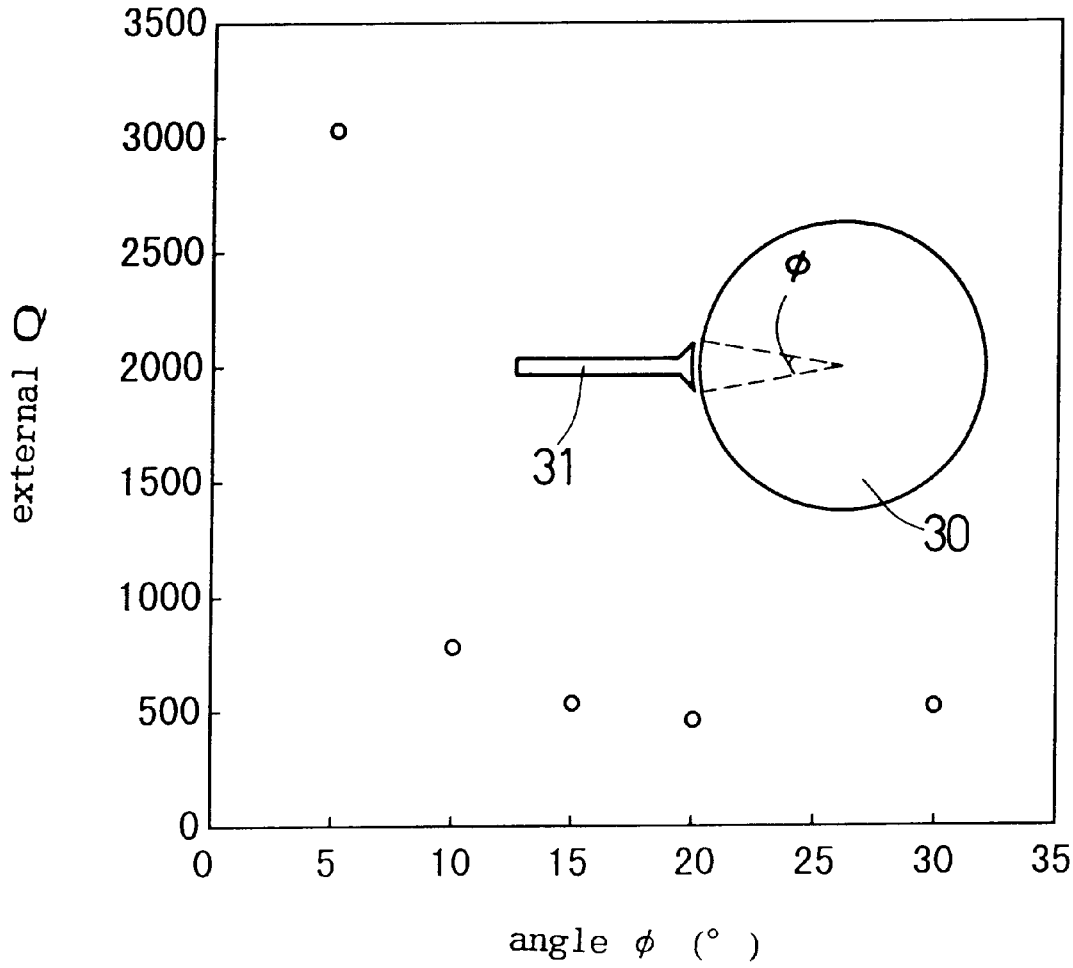
FIG. 14 (PRIOR ART)
FIG. 14 is a graph showing a comparative example of the relationship between the length of the coupling part and the degree of input-output coupling in a prior art high-frequency circuit element.

In FIG. 6, the change in the degree of input-output coupling when changing the angle θ is shown. The higher degree of input-output coupling can be obtained as the external Q of the resonance circuit becomes small. Therefore, the degree of input-output coupling herein is indicated by the external Q of the resonance circuit. As shown in FIG. 6, in the case of θ=20°, an external Q of about 120 is obtained. In the case of increasing the angle up to about θ=30°, it can be seen that the degree of input-output coupling increases. For the purpose of comparison, the change in the degree of input-output coupling in the conventional high-frequency element shown in FIG. 13 is shown in FIG. 14. In this case, the opening angle of the point of an input-output line 31 is indicated by an angle ϕ seen with respect to the center of a disc resonator 30. The distance between the point of the input-output line 31 and the disc resonator 30 (the gap part) is set to 20 μm as in FIG. 4. The structure is the same as that in FIG. 4 except for the input-output coupling part. As shown in FIG. 14, when making the angle ϕ wider in the conventional high-frequency circuit element shown in FIG. 13, the highest degree of input-output coupling (the external Q of about 450) can be obtained in the vicinity of 20°. When the angle ϕ is made wider than that, on the contrary, the external Q becomes greater. That is, the degree of input-output coupling becomes lower when making the angle ϕ wider than 20°. Thus, it is conceivable that since the intrinsic impedance of the input-output line 31 changes rapidly when the line width of the point of the input-output line 31 becomes broad and therefore an input-output signal is reflected, the degree of input-output coupling becomes low when making the angle ϕ wide to some extent. Therefore, when making a comparison under the same conditions, it is possible to decrease the external Q to around 100 in the structure of a high-frequency circuit element according to the present embodiment, but it is impossible to obtain a high degree of input-output coupling having the external Q of 450 or less in the structure of the conventional high-frequency element shown in FIG. 13.

As described above, it becomes possible to obtain a high degree of input-output coupling that has been impossible to realize in the conventional structure by employing the structure of a high-frequency circuit element according to the present embodiment. The structure of the present embodiment is very effective, since a relatively high degree of input-output coupling is generally required in resonator coupling type high-frequency filters.

Figure 7:
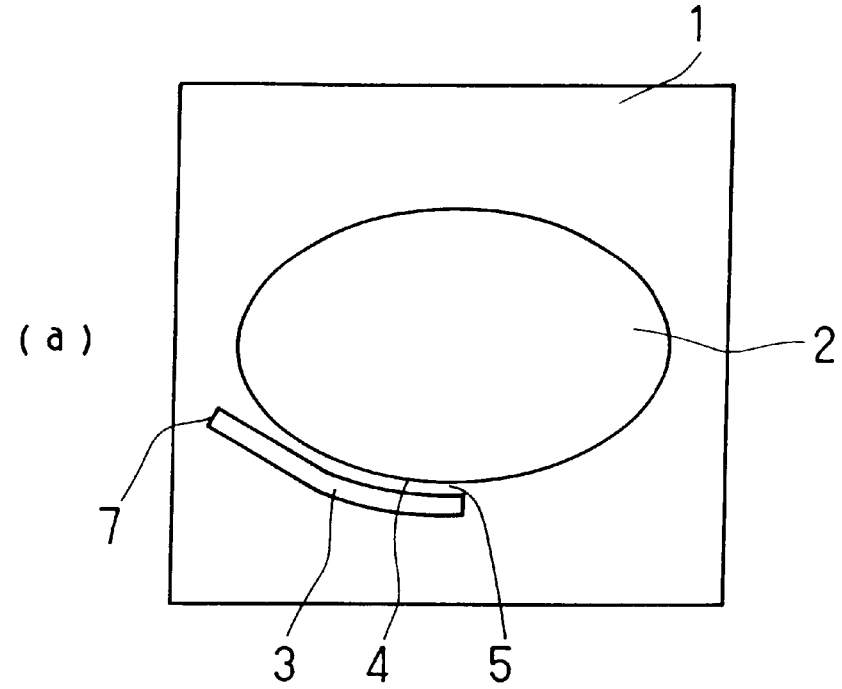
FIGS. 7(*a*) and 7(*b*) are plan views showing additional aspects of a high-frequency circuit element of the first embodiment of the present invention.
Figure 7:
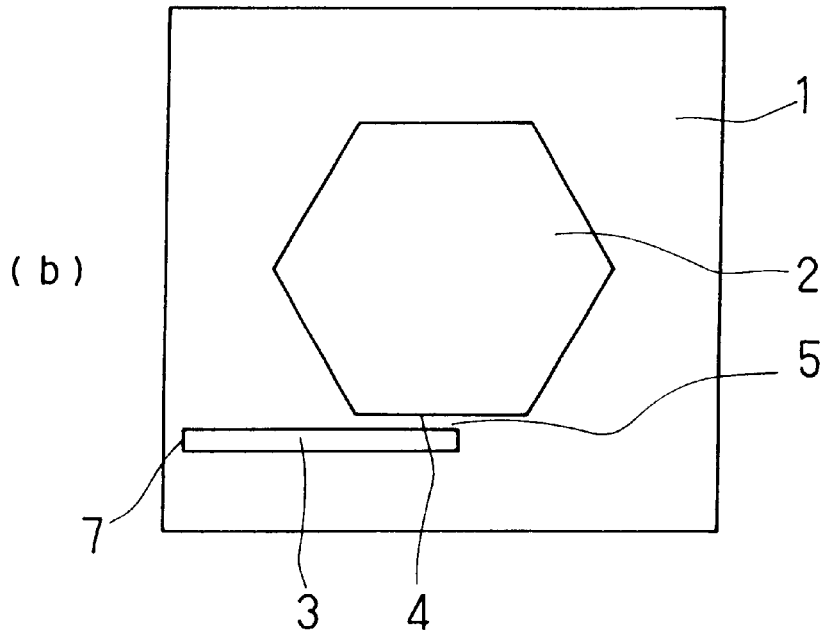

The present embodiment was described referring to an example using the circular resonator 2 as a resonator in a planar circuit structure. However, the present invention is not always limited to this configuration. As a resonator in a planar circuit structure, a resonator having any shape such as, for example, an elliptical resonator shown in FIG. 7(*a*) and a polygonal resonator shown in FIG. 7(*b*) can be used besides the circular resonator. FIG. 7(*a*) and FIG. 7(*b*) use the same reference numbers as already described in FIG 1. A high-frequency circuit element using a resonator having such a shape is also effective due to the same reasons as mentioned above.

The present embodiment was described referring to an example using a high-frequency circuit element comprising one resonator 2 and one input-output line 3. However, the present invention is not always limited to this configuration. The present invention can be applied to, for example, high-frequency circuit element such as a multistage filter using a plurality of resonators and a plurality of input-output lines and a high-frequency circuit element including a resonator and an input-output line as its part, and the same effectiveness can be exhibited.

<Second Embodiment>

Figure 8:
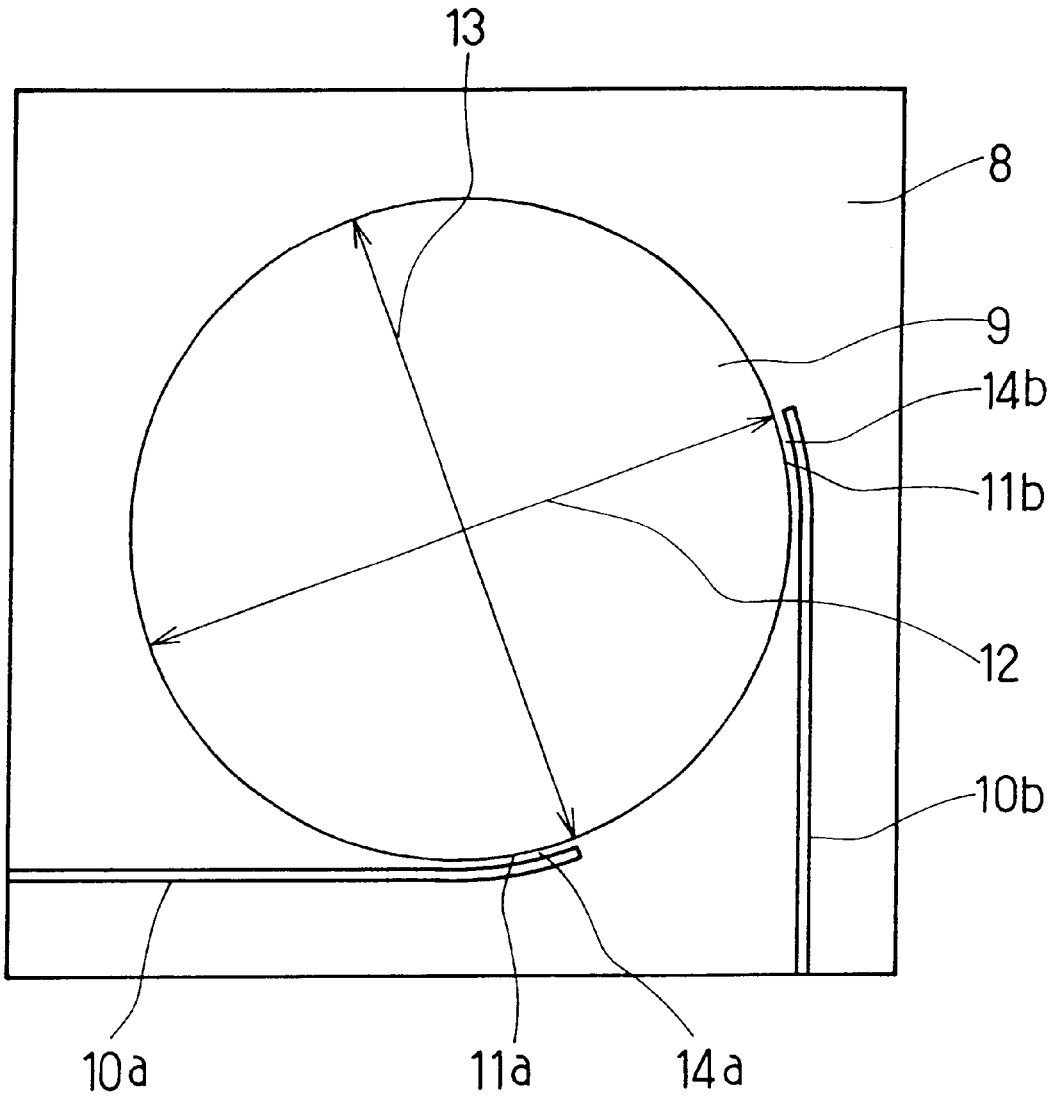
FIG. 8 is a plan view showing a second embodiment of a high-frequency circuit element according to the present invention.

FIG. 8 is a plan view showing a second embodiment of a high-frequency circuit element according to the present invention. As shown in FIG. 8, an elliptical resonator 9 made of a conductor film is formed at the center on a substrate 8 made of a dielectric monocrystal or the like by using, for example, a vacuum evaporation method and etching. The lengths of the major axis 12 and the minor axis 13 of the elliptical resonator 9 are set to 19.07 mm and 18.93 mm respectively. Using, for example, a vacuum evaporation method and etching, input-output lines 10*a* and 10*b* made of conductor films are formed on the same surface of the substrate 8 as the surface on which the resonator 9 is formed. In this case, the input-output lines 10*a* and 10*b* have side edges and their line widths are uniform. In addition, a part of the side edges of the input-output lines 10*a* and 10*b* is located along the coupling parts 11*a* and 11*b* on the peripheral part of the resonator 9, spaced from the resonator by the gap parts 14*a* and 14*b* respectively. In this case, coupling parts 11*a* and 11*b* are in the vicinity of the intersections of the periphery of the resonator 9 with the major axis 12 and the minor axis 13 respectively and are located at the positions that located 90° apart from each other as seen with respect to the center of the resonator 9. Both lengths of the coupling parts 11*a* and 11*b* are set to the lengths corresponding to an angle of 18° seen from the center of the resonator 9. On the entire back surface of the substrate 8, a ground plane (not shown in the figure) made of a conductor film is formed by using, for example, a vacuum evaporation method. This realizes a high-frequency circuit element having a microstrip structure.

Figure 9:
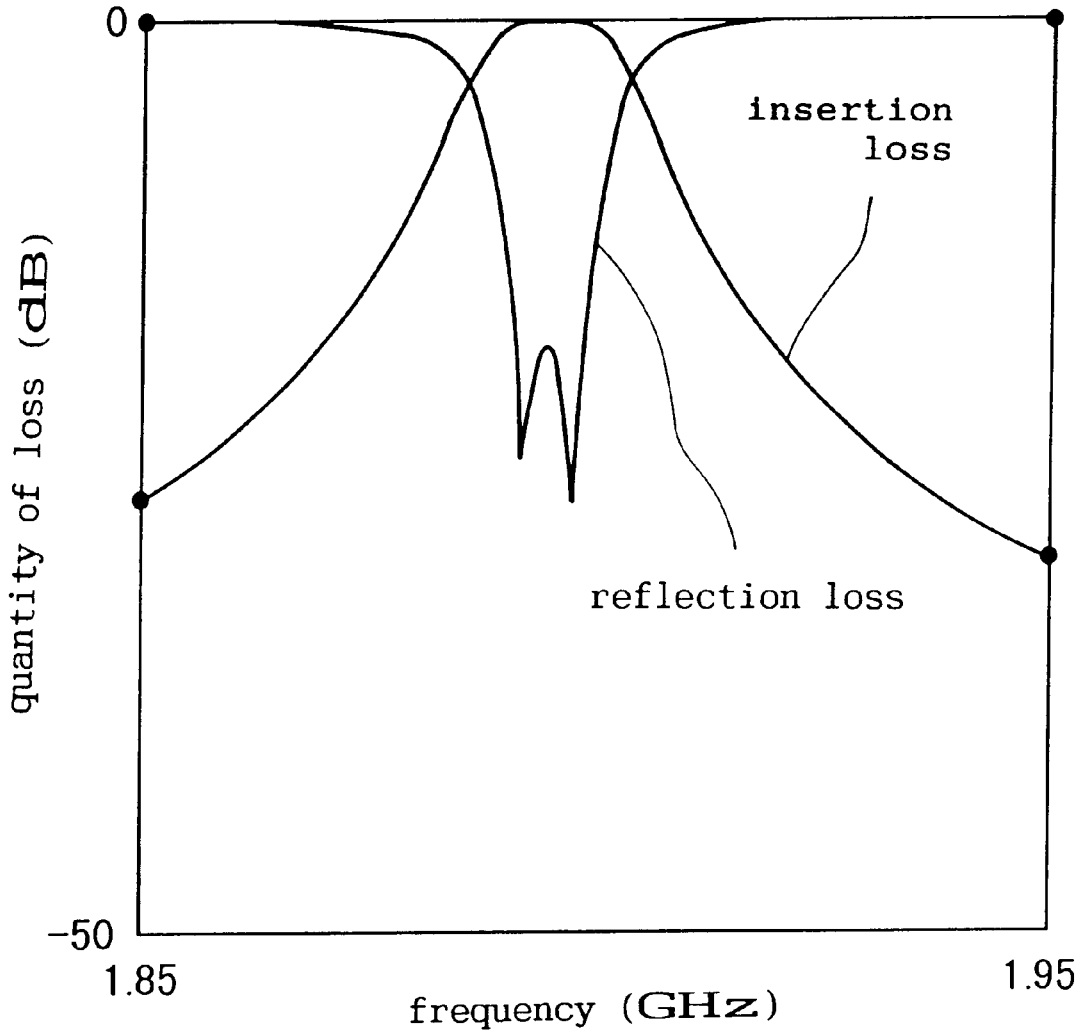
FIG. 9 is a graph of frequency response describing the characteristic of high-frequency circuit element of the second embodiment of the present invention.

FIG. 9 shows input-output characteristics for a high-frequency circuit element having such a structure as mentioned above. As shown in FIG. 9, a flat transmission characteristic (see the insertion characteristic in FIG. 9) can be obtained in the vicinity of 1.9 GHz in this element. Therefore, it can be found that the element operates as a band pass filter. This shows that the element can be operated as a two-stage resonator coupled filter by utilizing the coupling between two resonant modes of an elliptical resonator (see the reflection characteristic in FIG. 9, which has two peaks at the resonant frequencies of the two modes). In this type of filter, the peripheral part of the elliptical resonator is very smooth and the effect of current concentration within the resonator is small. Therefore, in the case of using an ordinary metal as a material of the resonator, the loss is smaller than that in the conventional structure.

Figure 10:
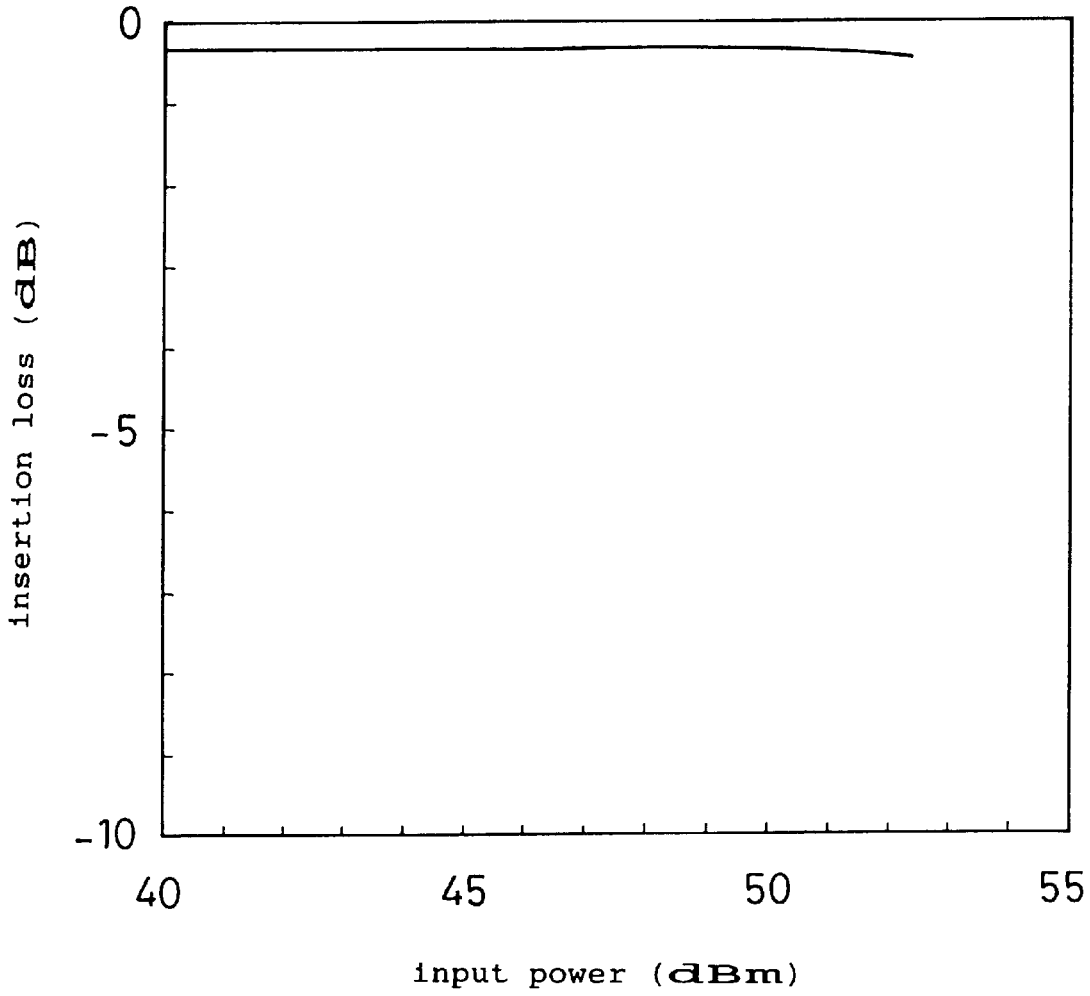
FIG. 10 is a graph showing insertion loss characteristics with respect to input power in a high-frequency circuit element of the second embodiment of the present invention.

FIG. 10 shows the dependence on input power of insertion loss in a passing band of a high-frequency circuit element having such a structure as mentioned above. A HP85108A pulsed RF network analyzer system manufactured by Hewlett Packard was used for the measurement. In this case, the measurement was conducted using a pulsed power signal having a pulse width of 2 $\mu$sec. so as not to be affected by generating heat in a cable for inputting-outputting signals into the element part. The environmental temperature was 20 Kelvin. As can be seen from FIG. 10, no clear change in the insertion loss for the input power up to +50 dBm (100 W) was found. In superconducting filters having a conventional structure, superconductivity is lost even for the input signal in a level of only tens of mW (about +15 dBm), thus becoming incapable of operating. Therefore, it can be found that the power endurance capacity of the present high-frequency circuit element is extremely excellent. This can be achieved by the following reasons: in the present high-frequency circuit element, the current concentration at the input-output line part and the resonator part is retained in a very low level; since the loss in the entire element is very small, the effect of generating heat corresponding to the loss is very small; and the like. This shows the effectiveness of the present high-frequency circuit element clearly.

On the other hand, in the case of using the conventional input-output coupling structure shown in FIG. 13 as the coupling part in the high-frequency circuit element of the present embodiment, the required degree of input-output coupling (the external Q=about 130) cannot be obtained. As a result, the input-output characteristics as shown in FIG. 9 cannot be obtained. This can be easily understood by comparing FIG. 6 with FIG. 14. In the case of using the conventional input-output coupling structure shown in FIG. 12, an abrupt change is given to the peripheral part of the resonator, and therefore localized concentration of current occurs within the resonator, thus causing a loss increase.

From the results mentioned above, it can be found that the structure of the high-frequency circuit element according to the present embodiment shown in FIG. 8 is very effective.

Figure 11:
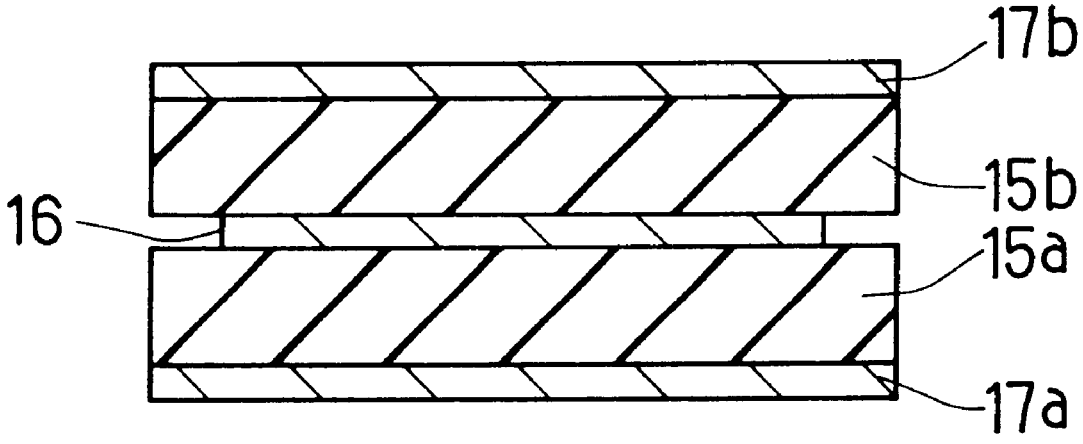
FIG. 11 is a cross-sectional view showing a high-frequency circuit element having a strip line structure of the present invention.

The embodiment mentioned above was described referring to a high-frequency circuit element having a microstrip structure. However, the present invention is not always applied only to the high-frequency circuit element having this structure. For example, the configuration of the present invention is also effective for a high-frequency circuit element having a strip line structure as shown in FIG. 11. In FIG. 11, each of numerals 15*a* and 15*b* indicates a substrate, numeral 16 indicates a resonator and each of numerals 17*a* and 17*b* indicates a ground plane. The strip line structure is a complex structure compared to the microstrip structure. However, the radiation loss becomes small and therefore the characteristics of the element can be improved.

The embodiment mentioned above was described referring to an example using an ordinary metal as a material of the resonator, but a superconductor can be used as a material of the resonator as well as the ordinary metals. When using a superconductor as a material of the resonator, a high-frequency circuit element having small loss and excellent power endurance characteristics can be realized. On the other hand, the use of a superconductor as a material of a resonator and a conventional input-output coupling structure shown in FIG. 12 causes the degradation in the power endurance characteristics.

A metal-based material (for example, a Pb-based material such as Pb, PbIn or the like, and a Nb-based material such as Nb, NbN, $Nb_3Ge$ or the like) may be used as a superconductor. However, in practical use, it is desirable to use a high-temperature oxide superconductor (for example, $Ba_2YCu_3O_7$) whose temperature condition is relatively lenient.

However, in the case of using a superconductor as a material of the resonator, superconducting current over the value of critical current density can not be applied. This becomes a problem in the case of handling a high-frequency signal having high power. In the high-frequency circuit element of the present invention, a resonator having a planar circuit structure is used that can effectively relieve the concentration of high-frequency current at the peripheral part of the resonator where the current is most extremely concentrated in the conventional structure. In addition, a high degree of input-output coupling can be obtained without changing the peripheral shape. Therefore, the maximum electric current density in the case of handling a high-frequency signal having the same power becomes lower than that in the conventional one. Consequently, in the case of constructing a high-frequency circuit element of the present invention using a superconductor having the same critical current density, it becomes possible to handle a high-frequency signal having further higher power. Thus, the effectiveness of the present invention is extremely high.

As described above, when employing the configuration of a high-frequency circuit element according to the present invention, a higher degree of input-output coupling for the resonator having a planar circuit structure can be obtained compared to that in the conventional one and the degree of freedom in designing a high-frequency circuit increases, thus realizing a high-performance high-frequency circuit element.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A high-frequency circuit element, comprising at least one solid disk resonator of elliptic shape having a smooth contour part and two input-output lines, wherein each of the input-output lines has a respective side edge and a part of the respective side edge is located along a corresponding coupling part on the respective peripheral part of the at least one resonator and spaced from the respective peripheral part of the at least one resonator by a gap part therebetween so as to reduce external Q to increase degree of input-output coupling, and the respective coupling parts are in the vicinity of intersections of the periphery of the at least one resonator with the major axis of the ellipse and the minor axis of the ellipse respectively and are located at the positions about 90° apart from each other with respect to the center of the at least one resonator.

2. A high-frequency circuit element, comprising at least one solid disk resonator of elliptical shape having a smooth contour part and at least one input-output line, wherein the input-output line is a single line having a first end for input/output of a high-frequency signal, a second end and a side edge, a part of the side edge by the second end of the input-output line being located along a coupling part on a peripheral part of the at least one resonator and spaced from the peripheral part of the at least one resonator by a gap part therebetween so as to reduce external Q to increase degree of input-output coupling.

3. The high-frequency circuit element according to claim 2, wherein the input-output line has a substantially uniform width.

4. The high-frequency circuit element according to claim 2, wherein the coupling part has a length which defines an angle with respect to the center of the at least one resonator and the angle is set in the range of 5–30°.

5. The high-frequency circuit element according to claim 2, wherein the distance of the gap part between the coupling part on the periphery of the at least one resonator and the input-output line is set in the range of 10–500 $\mu$m.

6. The high-frequency circuit element according to claim 2, having a microstrip structure.

7. The high-frequency circuit element according to claim 2, having a strip line structure.

8. The high-frequency circuit element according to claim 2, wherein the at least one resonator is comprised of a superconductor.

* * * * *